United States Patent [19]

Coduti et al.

[11] Patent Number: 4,999,241

[45] Date of Patent: Mar. 12, 1991

[54] COILED STEEL STRIP WITH SOLID LUBRICANT COATING

[75] Inventors: Phillip L. Coduti, Munster, Ind.; Louis McDaniel, Lansing, Ill.

[73] Assignee: Inland Steel Company, Chicago, Ill.

[21] Appl. No.: 555,651

[22] Filed: Jul. 20, 1990

Related U.S. Application Data

[63] Continuation of Ser. No. 294,682, Jan. 9, 1989, abandoned.

[51] Int. Cl.[5] ..... B32B 15/04; B21B 45/02

[52] U.S. Cl. ..... 428/340; 72/41; 72/42; 252/51.5 A; 252/56 S; 228/457; 228/467

[58] Field of Search ..... 428/457, 467, 469, 219, 428/340; 252/33.4, 56 S, 51.5 A; 72/41, 42

[56] References Cited

U.S. PATENT DOCUMENTS

| | | | |
|---|---|---|---|
| 3,258,319 | 6/1966 | Cox | 428/467 X |
| 4,191,801 | 3/1980 | Jahnke | 428/467 |
| 4,321,308 | 3/1982 | Jahnke | 428/469 |
| 4,753,743 | 6/1988 | Sech | 252/33.4 |

OTHER PUBLICATIONS

Phillip L. Coduti, "Tribological Behavior of Solid Lubricant Films on Bare and Coated Sheet Steel Products", Feb. '87 (SAE Technical Paper Series, Paper No. 870,648).

Phillip L. Coduti, "Forming Prepainted Steel Products Coated with Solid Lubricant Films-An Alternative to Post-Painting", Feb. 23-27, 1987 (SAE Technical Paper Series, Paper No. 870,179).

Phillip L. Coduti, "The Production and Implementation of Prelubricated Cold Rolled Steel", Sep. '86 (Lubrication Engineering, pp. 532-538).

*Primary Examiner*—Thomas J. Herbert

*Attorney, Agent, or Firm*—Marshall, O'Toole, Gerstein, Murray & Bicknell

[57] ABSTRACT

A coil of pre-lubed steel strip has a steel strip substrate coated on each surface with a uniform coating of solid lubricant. The coating has a coating weight greater than 20 mg/ft.$^2$ (0.22 g/m$^2$) for lubricity during cold deforming of the strip, as by stamping or drawing. The coating weight is less than 100 mg/ft.$^2$ (1.08 g/m$^2$) to prevent slippage during operations incident to blanking of the strip prior to cold deforming. The coating has a needle penetration hardness in the range 9-250. Various procedures for applying the coating are described.

17 Claims, No Drawings

COILED STEEL STRIP WITH SOLID LUBRICANT COATING

This application is a continuation of application Ser. No. 294,682, filed Jan. 9, 1989, now abandoned.

BACKGROUND OF THE INVENTION

The present invention relates generally to coiled steel strip and more particularly to coiled steel strip with a solid lubricant coating.

Coiled steel strip is the starting material for a number of manufacturing operations involving cold deforming, such as a stamping or drawing operation. These manufacturing operations are used to produce parts for automobiles and appliances, for example.

Before the steel strip undergoes the cold deforming operation, it is subjected to a blanking operation in which the coiled strip is uncoiled and cut into smaller pieces called blanks. The blanks are then individually subjected to the cold deforming operation. Incident to the blanking operation is the employment of equipment including metering rollers which meter the uncoiled strip to the blanking station and leveling or flattening rollers which remove from the steel strip any residual curvature or "coil set" carried over from the coil.

To facilitate the cold deforming operation, the surfaces of the steel strip are coated with a lubricant prior to cold deforming. It is also desirable to protect the steel strip against corrosion between the time it was coiled at the steel mill and the time it is uncoiled incident to the blanking operation. The coiled steel strip can be coated with a film of material which functions both as a corrosion resisting agent and as a lubricant during the cold deforming operation. Coiled steel strip coated with such material is known as pre-lubed strip. The coating material can be either liquid or solid. An example of a solid coating material for pre-lubed steel strip is described in Sech, U.S. Pat. No. 4,753,743, entitled "Hot Melt Metal Working Lubricant", and the disclosure thereof is incorporated herein by reference.

Many of the considerations involved in the cold deforming of steel strip, and in the selection of a pre-lube coating material for steel strip subjected to cold deforming are discussed in detail in the Sech patent and need not be repeated here. The solid lubricant coating disclosed in the Sech patent comprises, in a general sense, (a) a major portion composed of at least one substantially saturated ester formed of a polyhydric alcohol and at least one carboxylic acid; (b) a plasticizer for (a); and (c) a small amount of a polymeric composition. The Sech patent contains a number of examples in which steel blanks are coated with a solid lubricant having a coating weight in the range 100–1000 mg/ft.$^2$ (1.08–10.8 g/m$^2$).

A problem which can arise incident to a blanking operation performed on pre-lubed steel strip is slippage of the strip at the metering rollers and the leveling rollers. Slippage at the metering or leveling rollers can cause variations in the size of the blanks which is undesirable. Slippage can occur if there is too much lubricating material on the steel strip. On the other hand, during the cold deforming operation, if there is too little lubricating material on the steel strip, the lubricity of the steel strip is impaired, and this can have an adverse effect on the cold deforming operation and on the part produced thereby.

There is a paper delivered Feb. 23, 1987, SAE Technical Paper Series, 870648, entitled "Tribological Behavior of Solid Lubricant Films on Bare and Coated Sheet Steel Products", Phillip L. Coduti, author. This paper describes tests conducted on a steel strip coated with a solid lubricant having a coating weight of 200±25 mg/ft.$^2$ (2.16±0.27 g/m$^2$) on each side. One of the tests involved varying the hardness of the coating by increasing the oil content thereof. Hardness was determined with a needle penetration test: the deeper the penetration, the softer the coating. The hardness was reflected by a hardness number: the larger the number, the softer the coating. The hardness of the coating was compared with the lubricity of the coating, and it was found that, at a needle penetration hardness in the range 20–30, lubricity was maximized for a coating of 200±25 mg/ft.$^2$ (2.16±0.27 g/m$^2$).

SUMMARY OF THE INVENTION

In accordance with the present invention, there is provided a coil of pre-lubed steel strip in which the coating weight and hardness of the coating of solid lubricant are controlled both to provide a desired amount of lubricity and to avoid slippage during operations incident to the blanking of the uncoiled strip. In this regard, the coating has a coating weight greater than 20 mg/ft$^2$ (0.22 g/m$^2$) for lubricity purposes and less than 100 mg/ft$^2$ (1.08 g/m$^2$) to prevent slippage. In addition, the coating has a needle penetration hardness number in the range 9–250. Preferably, the coating weight is greater than 50 mg/ft.$^2$ (0.54 g/m$^2$), and the hardness number is in the range 20–30.

The lubricant with which the steel substrate is coated is solid at room temperature, lubricates the substrate during a stamping or drawing operation, protects the substrate against corrosion and is non-staining to the substrate. In a preferred embodiment, the solid lubricant has other desired properties which will be described below in more detail.

Other features and advantages are inherent in the product and method claimed and disclosed or will become apparent to those skilled in the art from the following detailed description.

DETAILED DESCRIPTION

A coil of pre-lubed steel strip in accordance with the present invention comprises a substrate composed of steel strip and a uniform coating of solid lubricant on each surface of the substrate. The substrate is selected from the group comprising: cold rolled steel strip; phosphated, cold rolled steel strip; hot-dip galvanized steel strip; electro-galvanized steel strip; phosphated, galvanized steel strip; galvannealed steel strip; phosphated, galvannealed steel strip; aluminized steel strip; enameling iron steel strip; pre-primed steel strip; and prepainted steel strip.

The solid lubricant may be any of the solid lubricants heretofore employed to provide a coating on a coil of pre-lubed steel strip, so long as the solid lubricant has the properties and characteristics described below. One preferred embodiment of solid lubricant is the hot melt, metal working lubricant described in Sech, U.S. Pat. No. 4,753,743. This lubricant may be generally described as comprising: (a) a major portion composed of at least one substantially saturated ester formed of a polyhydric alcohol and at least one carboxylic acid; (b) from 5 to 15 wt. % of a plasticizer for (a); and (c) from 0.5 to 3.0 wt. % of a polymeric composition. More specific descriptions of examples of this solid lubricant and its ingredients are contained in the Sech patent, the disclosure of which has been incorporated herein by reference.

Other types of solid lubricants, which may be employed as the coating on a coil of pre-lubed steel strip in accordance with the present invention, include lubricants containing as the principle ingredient: oleic acid; paraffin wax; 1-dodecanol; hydrogenated tallow; aliphatic acids having at least 12 carbon atoms; copper laurate; pentaerythritol tetrastearate and tartaric acid. Each of the principle ingredients described in the preceding sentence may be used alone (neat) or blended with plasticizers and/or antioxidants.

Specific examples of other solid lubricants which may be employed as a coating on a coil of pre-lubed steel strip in accordance with the present invention are described in Cox, U.S. Pat. No. 3,258,319 which describes a molten wax-polymer blend, and in Jahnke, U.S. Pat. Nos. 4,191,801 and 4,321,308 which describe ester compositions. The disclosures of the Cox and Jahnke patents are incorporated herein by reference.

A solid lubricant employed in accordance with the present invention has at least the following properties: (a) solid at room temperature; (b) the ability to lubricate the substrate during a stamping or drawing operation; (c) the ability to protect the substrate against corrosion between the time the coil is formed and the blanking operation, including storage periods; and (d) is non-staining to the substrate.

The solid lubricant preferably should be readily meltable at an elevated temperature, above room temperature, for ease of application to the substrate with the lubricant in a molten state. Typically, a melting temperature for the solid lubricant is in the range 48–100° C. (120–212° F.).

Preferably, the solid lubricant should be readily removable from the substrate with an alkaline solvent, the material usually employed by one who performs stamping and drawing operations to clean the stamped or drawn part prior to subsequent manufacturing operations thereon.

In addition, the solid lubricant preferably has at least one of the following further properties: compatibility with chemicals employed in a painting operation on a part made from the substrate; compatibility with a structural adhesive employed to bond another part to a part made from the substrate; and compatibility with a welding operation on the substrate.

The lubricity or coefficient of friction of a pre-lubed steel strip is dependent upon the thickness of the coating, which may be expressed as coating weight (weight of coating per unit area of substrate). Generally, a coating weight greater than 20 mg/ft.$^2$ (0.22 g/m$^2$) is necessary to impart a desired lubricity to the pre-lubed steel strip. Preferably, the coating weight is greater than 50 mg/ft.$^2$ (0.54 g/m$^2$).

As the coating weight increases above 20 mg/ft.$^2$ (0.22 g/m$^2$), the rate of increase in lubricity decreases substantially between 20 and 50 mg/ft$^2$ (0.22 and 0.54 g/m$^2$), and the rate of increase decreases even more substantially between 50 and 100 mg/ft$^2$ (0.54 and 1.08 g/m$^2$). Between 100 and 150 mg/ft$^2$ (1.08 and 1.62 g/m$^2$) there is no substantial increase in lubricity, and between 150 and 400 mg/ft$^2$ (1.62 and 4.32 g/m$^2$), the increase in lubricity is relatively slight.

With coating weights above 100 mg/ft$^2$ (1.08 g/m$^2$), there is a danger of slippage during operations incident to blanking. More particularly, during blanking, the pre-lubed strip is fed from the coil in sequence (1) between a set of upper and lower leveling rollers and then (2) between a set of upper and lower metering rollers, prior to the actual blanking step. If the distance from end to end of both the upper and lower rollers in a set of rollers equals or exceeds the width of the strip, a heavier coating weight can be employed before slippage begins at that set. In some instances, particularly with respect to the metering rollers, at least one of the rollers is not coextensive with the width of the strip, and in such instances, slippage will occur with a lighter coating weight than when both upper and lower rollers are coextensive with the width of the strip.

Because the coil producer often cannot know in advance the dimensions of the rollers which will be employed for a given coil, it is important that the pre-lubed steel strip have a solid lubricant coating weight which will avoid slippage under virtually all circumstances, no matter the dimensions of the rollers. In accordance with the present invention, the coating weight is limited to less than 100 mg/ft$^2$ (1.08 g/m$^2$). Generally, with a coating weight between 100 and 150 mg/ft.$^2$ (1.08–1.62 g/m$^2$) there can be slippage, depending upon the dimensions of the rollers employed incident to blanking; but below 100 mg/ft.$^2$, the possibility of slippage is virtually nil. Moreover, so long as the coating weight is greater than 20 mg/ft$^2$ (0.22 g/m$^2$), preferably greater than 50 mg/ft.$^2$ (0.54 g/m$^2$), there is no substantial sacrifice in lubricity by limiting the coating weight to less than 100 mg/ft$^2$ (1.08 g/m$^2$). Examples of coating weights in accordance with the present invention include 95 mg/ft.$^2$ (1.03 g/m$^2$), 80 mg/ft.$^2$ (0.86 g/m$^2$) and 40 mg/ft.$^2$ (0.43 g/m$^2$).

Another feature of a coil of pre-lubed steel strip in accordance with the present invention is the hardness of the solid lubricant coating. The hardness of a solid lubricant can be decreased by diluting the solid lubricant with a liquid, oil-based lubricant of low viscosity in which the solid lubricant is soluble. The solid lubricant may be diluted with mineral oil or dioctylsebbacate or any lubricating oil in which the solid lubricant is soluble. Other liquid lubricants heretofore employed to lubricate steel strip during stamping or drawing operations may be employed as a diluent or softener for the solid lubricant, so long as the solid is soluble in the liquid.

The curve which reflects the plot of lubricity against hardness is shaped like a parabola. As the hardness of the solid lubricant decreases, there is an initial increase in lubricity. Thereafter, as the hardness decreases further, there is a decrease in lubricity until eventually the hardness decreases to a point below which the lubricity is less than that of the undiluted, full hard, solid lubricant.

The hardness of a solid lubricant is expressed in terms of a needle penetration hardness number determined by performing a test with a penetrometer. The penetrometer applies a standard needle to a sample block of the solid lubricant for five seconds under a load of 100 g. The needle penetration depth in millimeters is a measure of the solid lubricant's hardness. This test is identified as "ASTM D 1321-76, Standard Test Method for Needle Penetration of Petroleum Waxes," *Annual Book of ASTM Standards, Part* 23, Amer. Soc. for Testing and Materials, Philadelphia, Pa., 1981, pp. 720–723.

In accordance with the present invention, the solid lubricant should have a needle penetration hardness number in the range 9–250, preferably in the range 20–30. Maximum lubricity is obtained when the hardness number is in the range 20–30, and desirable lubricity is obtained when the hardness is in the range 9–250.

A coating weight in accordance with the present invention not only prevents slippage but also prevents a build-up of solid lubricant on the metering rollers and the leveling rollers and on the dies employed for the stamping or drawing operations.

The solid lubricant may be applied to the surface of the substrate by melting the solid lubricant and then applying the lubricant to the surface of the substrate in a molten form, preferably by roll coating. An embodiment of a roll coating operation in accordance with the present invention employs at least three mutually engaging, rotating, hard rubber rolls. One rotating roll is partially immersed in a bath of the molten lubricant. The partially immersed rotating roll picks up molten lubricant from the bath and transfers the molten lubricant to an intermediate rotating roll, which in turn transfers molten lubricant to a third rotating roll which transfers the molten lubricant to the surface of the substrate. The steel strip entering the three-roll arrangement is preheated to a temperature slightly above the melting point of the lubricant (e.g., at least 5–10° F. above), and all three rolls are at a similar elevated temperature. A desired coating weight of less than 100 mg/ft.$^2$ (1.08 g/m$^2$) can be obtained with rubber rolls having a durometer hardness of at least 50.

In another roll coating procedure, the solid lubricant is dissolved in a volatile solvent to make a liquid solution. This liquid solution is then applied with rotating rolls using either the three-roll arrangement described above, or a two-roll arrangement. In the two-roll arrangement, the intermediate roll is eliminated, and the solution is transferred from the partially immersed roll directly to the substrate-contacting roll. The substrate coated with liquid solution is then heated in an oven to drive off the solvent and melt the solid lubricant which comes out of the solution, following which the substrate with applied coating is water-quenched to solidify the molten lubricant. In this procedure, the hardness of the roll is not critical. The drawback to this procedure is that volatile solvents are dangerous in a steel mill environment. However, this procedure can be employed in an environment remote from a steel mill.

A solid lubricant coating having a coating weight in accordance with the present invention is essentially transparent. Transparency is a desirable characteristic of a lubricant coating because a transparent coating does not mask defects on the surface of the steel substrate or mask the color of the paint on a pre-painted steel substrate.

A solid lubricant coating must not only be thin, but also it must be continuous and uniform. In order to achieve continuity and uniformity, the solid lubricant should be applied by roll coating, as described above. The lubricant cannot be applied as a powder, and it cannot be applied by merely mechanically spraying a solution of the solid lubricant, as the latter procedure would produce a mottled film. Although a continuous, uniform coating can be obtained by brush application of the lubricant in a molten or solution form, brush application is not a commercially practical procedure for obtaining a coating weight in accordance with the present invention.

Electrostatic spraying is another application procedure which may be employed. In this procedure, the solid lubricant is dissolved in a volatile solvent, and the resulting solution is applied by electrostatic spraying followed by a drying step to evaporate the solvent. The resultant coating is uniform, continuous, thin and transparent.

Electrostatic spraying may also be employed using the lubricant in hot, neat, molten form. In this procedure, after electrostatic spray application of the molten lubricant, a heated leveling roll can be used to even out the coating. The leveling roll should be at least 5–10° F. above the melting point of the lubricant.

The foregoing detailed description has been given for clearness of understanding only, and no unnecessary limitations should be understood therefrom, as modifications will be obvious to those skilled in the art.

What is claimed is:

1. A coil of pre-lubed steel strip, said strip comprising:

a steel strip substrate;

and a uniform coating of solid lubricant on each surface of said substrate;

said coating having a coating weight greater than 20 mg/ft.$^2$ (0.22 g/m$^2$) for lubricity purposes and less than 95 mg/ft.$^2$ (1.03 g/m$^2$) to prevent slippage during operations incident to the blanking of the coiled strip;

said coating having a needle penetration hardness number in the range 9–250.

2. A coil of pre-lubed steel strip as recited in claim 1 wherein:

said coating weight is greater than 50 mg/ft.$^2$ (0.54 g/m$^2$).

3. A coil of pre-lubed steel strip as recited in claim 1 wherein:

said coating has a needle penetration hardness number in the range 20–30.

4. A coil of pre-lubed steel strip as recited in claim 1 wherein said substrate is selected from the group comprising:

cold rolled steel strip;
phosphated, cold rolled steel strip;
hot-dip galvanized steel strip;
electro-galvanized steel strip;
phosphated, galvanized steel strip;
galvannealed steel strip;
phosphated, galvannealed steel strip;
aluminized steel strip;
enameling iron steel strip;
pre-primed steel strip;
pre-painted steel strip.

5. A coil of pre-lubed steel strip as recited in claim 1 wherein said solid lubricant comprises:

(a) a major portion composed of at least one substantially saturated ester formed of a polyhydric alcohol and at least one carboxylic acid;

(b) from 5 to 15 wt. % of a plasticizer for (a); and (c) from 0.5 to 3.0 wt. % of a polymeric composition.

6. A coil of pre-lubed steel strip as recited in claim 1 wherein said solid lubricant has at least the following proper(a)

(a) solid at room temperature;

(b) lubricates said substrate during a stamping or drawing operation;

(c) protects said substrate against corrosion; and (d) non-staining to said substrate.

7. A coil of pre-lubed steel strip as recited in claim 6, wherein said solid lubricant has at least one of the following additional properties;

(e) readily meltable at an elevated temperature, above room temperature, for ease of application to said substrate with the lubricant in a molten state; and (f) readily removable from said substrate with an alkaline solvent.

8. A coil of pre-lubed steel strip as recited in claims 6 or 5 wherein said lubricant has at least one of the following further properties:

(g) compatible with chemicals employed in a painting operation on a part made from said substrate;

(h) compatible with a structural adhesive employed to bond another part to a part made from said substrate; and (i) compatible with a welding operation on said substrate.

9. In a blanking procedure for converting, into blanks, a coil of pre-lubed steel strip having a steel substrate with both surfaces covered with a uniform coating of solid lubricant, a method for preventing slippage during metering and leveling operations incident to said blanking procedure, said method comprising:

limiting said solid lubricant on the coiled strip to a coating weight less than 95 mg/ft.$^2$ (1.03 g/m$^2$).

10. In a procedure as recited in claim 9 wherein:

said coating weight is at least 20 mg/ft.$^2$ (0.22 g/m$^2$).

11. In a procedure as recited in claim 10 wherein:

said coating weight is at least 50 mg/ft.$^2$ (0.54 g/m$^2$).

12. In a procedure as recited in claim 10 wherein:

said coating has a needle penetration hardness number in the range 9–250.

13. In a procedure as recited in claim 12 wherein:

said coating has a needle penetration hardness number in the range 20–30.

14. In a procedure as recited in claim 9 wherein said method comprises:

melting a solid lubricant;

and applying said lubricant to the surface of said substrate in molten form, by roll coating.

15. In a procedure as recited in claim 14 wherein said applying step comprises:

partially immersing one rotating roll in a bath of said molten lubricant;

transferring molten lubricant from said one rotating roll to another rotating roll;

and transferring said molten lubricant from said other rotating roll to said surface of said substrate.

16. In a procedure as recited in claim 15 wherein said transferring steps comprise:

transferring said molten lubricant from said one roll initially to an intermediate rotating roll and then to said other roll.

17. In a procedure as recited in claim 16 wherein:

said rolls have a durometer hardness of at least about 50.

* * * * *

UNITED STATES PATENT AND TRADEMARK OFFICE

CERTIFICATE OF CORRECTION

PATENT NO. : 4,999,241

DATED : March 12, 1991

INVENTOR(S) : Phillip L. Coduti, et al.

It is certified that error appears in the above-identified patent and that said Letters Patent is hereby corrected as shown below:

In the Claims:

Col. 6, line 60 change "proper(a)" to --properties:--.

Signed and Sealed this

Fifteenth Day of December, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,999,241

DATED : March 12, 1991

INVENTOR(S) : Phillip L. Coduti, et al.

It is certified that error appears in the above-identified patent and that said Letters Patent is hereby corrected as shown below:

Col. 7, line 7 change "5" to --7--.

Signed and Sealed this

Twenty-third Day of November, 1993

*Attest:*

*Attesting Officer*

Bruce Lehman

BRUCE LEHMAN

*Commissioner of Patents and Trademarks*